US007123853B2

(12) United States Patent
Andou

(10) Patent No.: US 7,123,853 B2
(45) Date of Patent: Oct. 17, 2006

(54) IMAGE FORMING DEVICE OPERATIVELY CONFIGURABLE IN ACCORDANCE WITH AURAL CONDITIONS IN THE VICINITY THEREOF

(75) Inventor: Hironori Andou, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 162 days.

(21) Appl. No.: 10/841,458

(22) Filed: May 10, 2004

(65) Prior Publication Data

US 2004/0264997 A1 Dec. 30, 2004

(51) Int. Cl.
*G03G 15/00* (2006.01)

(52) U.S. Cl. ..... 399/81

(58) Field of Classification Search ..... 399/79, 399/80, 81, 91
See application file for complete search history.

(56) References Cited

U.S. PATENT DOCUMENTS

| | | | | |
|---|---|---|---|---|
| 6,701,095 | B1 * | 3/2004 | Fujimoto et al. | 399/9 |
| 2003/0023444 | A1 * | 1/2003 | St. John | 704/270.1 |
| 2004/0136539 | A1 * | 7/2004 | Uhi et al. | 381/56 |

FOREIGN PATENT DOCUMENTS

| | | | |
|---|---|---|---|
| JP | H06-194885 | | 7/1994 |
| JP | 2000181292 | A * | 6/2000 |
| JP | 2000216943 | A * | 8/2000 |

* cited by examiner

*Primary Examiner*—David M. Gray
*Assistant Examiner*—Ryan Gleitz
(74) *Attorney, Agent, or Firm*—Shinjyu Global IP

(57) ABSTRACT

An image forming device is disclosed which collects sounds in the vicinity of the image forming device, and then determines the characteristics of the collected sounds. The image forming device will then select an operation mode based upon the characteristics of the collected sounds, and will generate notification sounds and operate in accordance with the selected operation mode.

11 Claims, 4 Drawing Sheets

IMAGE FORMING DEVICE OPERATIVELY CONFIGURABLE IN ACCORDANCE WITH AURAL CONDITIONS IN THE VICINITY THEREOF

BACKGROUND OF THE INVENTION

1. Field of the Invention

The present invention relates to an image forming device such as a copying machine, a digital multi-functional device, a printer, and the like.

2. Background Information

Image forming devices such as copying machines, digital multi-functional devices, printers, and the like are now widely used in offices. When these types of image forming devices perform tasks such as copying original documents and printing data received by facsimile, noises will be generated thereby such as the sound of the transfer drum rotating and the sound of paper being transported, printed and discharged.

Because of that, it will be difficult to hear another person's voice over the telephone or during a face-to-face conversation if, for example, these conversations occur in the vicinity of an image forming device performing these types of operations.

In response to this problem, image forming devices that, for example, are able to somewhat prevent this noise from being generated, or that have high soundproofing capabilities so that noise generated during copying and printing will not leak out of the device, have recently been developed (see, for example, Japanese Published Patent Application No. H06-194885).

However, it is difficult to completely prevent the aforementioned noise from being generated, and also difficult to completely prevent this noise from leaking out of the image forming device. In addition, the cost of the image forming device will increase if a configuration that improves the soundproofing capabilities thereof or suppresses the generation of noise therein is adopted.

In addition, sounds generated by the image forming device not only include the noise generated during printing, but also include, for example, notification sounds that inform a user that the operation keys displayed on the operation panel of the image forming device have been pressed, a notification sound that indicates receipt of facsimile by the image forming device, a notification sound that indicates that printing is completed, a notification sound that warns a user of the existence of a problem such as a lack of paper, and the like. Because these sounds are not very loud, there is almost no difficulty for a person to speak to someone over the telephone or in person while in the vicinity of the image forming device. However, there are times in which these notification sounds will be drowned out by the background noise of the office because they are not loud enough. Thus, when background noise is being generated in the office, there will be times when, for example, the user will not be able to recognize that an operation key has been pushed, will not notice that data has been received by facsimile, or will not notice that the device has run out of paper.

SUMMARY OF THE INVENTION

Accordingly, it is an object of the present invention to provide an image forming device that does not disturb those inside an office with noise generated during printing and the like, and which generates notification sounds that can be easily heard by a user.

An image forming device of the present invention operates in an operation mode that will change in accordance with aural conditions in the vicinity of the image forming device. The image forming device includes a sound collecting unit that serves to comprehend aural conditions in the vicinity of the image forming device. The characteristics of sounds collected by the sound collecting unit are then determined by a determination unit.

In addition, the image forming device includes a storage unit that stores the sounds collected by the sound collection unit and designated for storage by a user, and a mode switching unit that will switch the operation mode of the image forming device based upon similarities between the characteristics of one or more sounds stored in the storage unit and the characteristic of a sound collected by the sound collection unit.

For example, if there is a sound that is difficult to hear due to noise generated by printing, the user will collect that sound with the sound collection unit, and the characteristic of that sound will be determined by the determination unit and then be stored in the storage unit. Then, if the characteristic of a sound collected by the sound collection unit is the same as or similar to the characteristic of one or more of the sounds stored in the storage unit, the mode switching unit will switch to an operation mode that reduces the noise of printing. This will eliminate disturbances to work being performed in the vicinity of the image forming device that are caused by noise generated when printing.

In addition, in order to prevent notification sounds generated by the image forming device from being drowned out by sounds generated in the vicinity of the image forming device, the mode switching unit will switch to an operation mode that can generate notification sounds (sounds used to notify a user of the image forming device) having characteristics that are different from the characteristic of a sound collected by the sound collection unit.

For example, if the characteristic of a sound collected by the sound collection unit does not have a minimum degree of similarity to the characteristics of the sounds stored in the storage unit, the mode switching unit will switch to an operation mode in which the volume of the notification sounds are increased. Thus, the notification sounds will no longer be drowned out by sounds generated in the vicinity of the image forming device.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

1. First Embodiment

Figure 1:
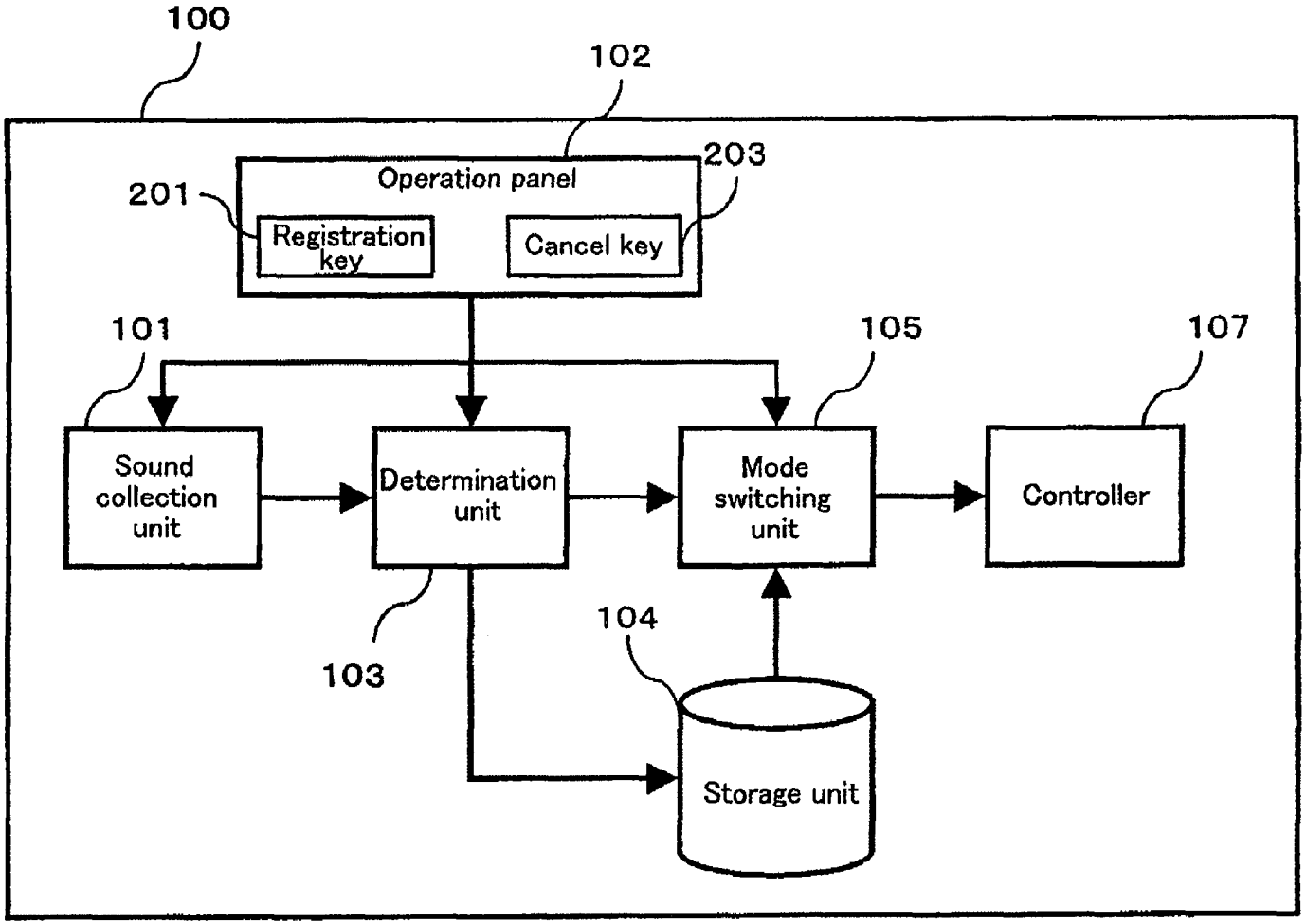
FIG. 1 is a functional block diagram of an image forming device according to a first embodiment of the present invention.

As shown in FIG. 1, an image forming device 100 of the present invention includes a sound collection unit 101. When each key displayed on an operation panel 102 provided on an upper surface of the image formation device 100 is pressed, a command corresponding to each key pressed will be input into the sound collection unit 101.

Figure 3:
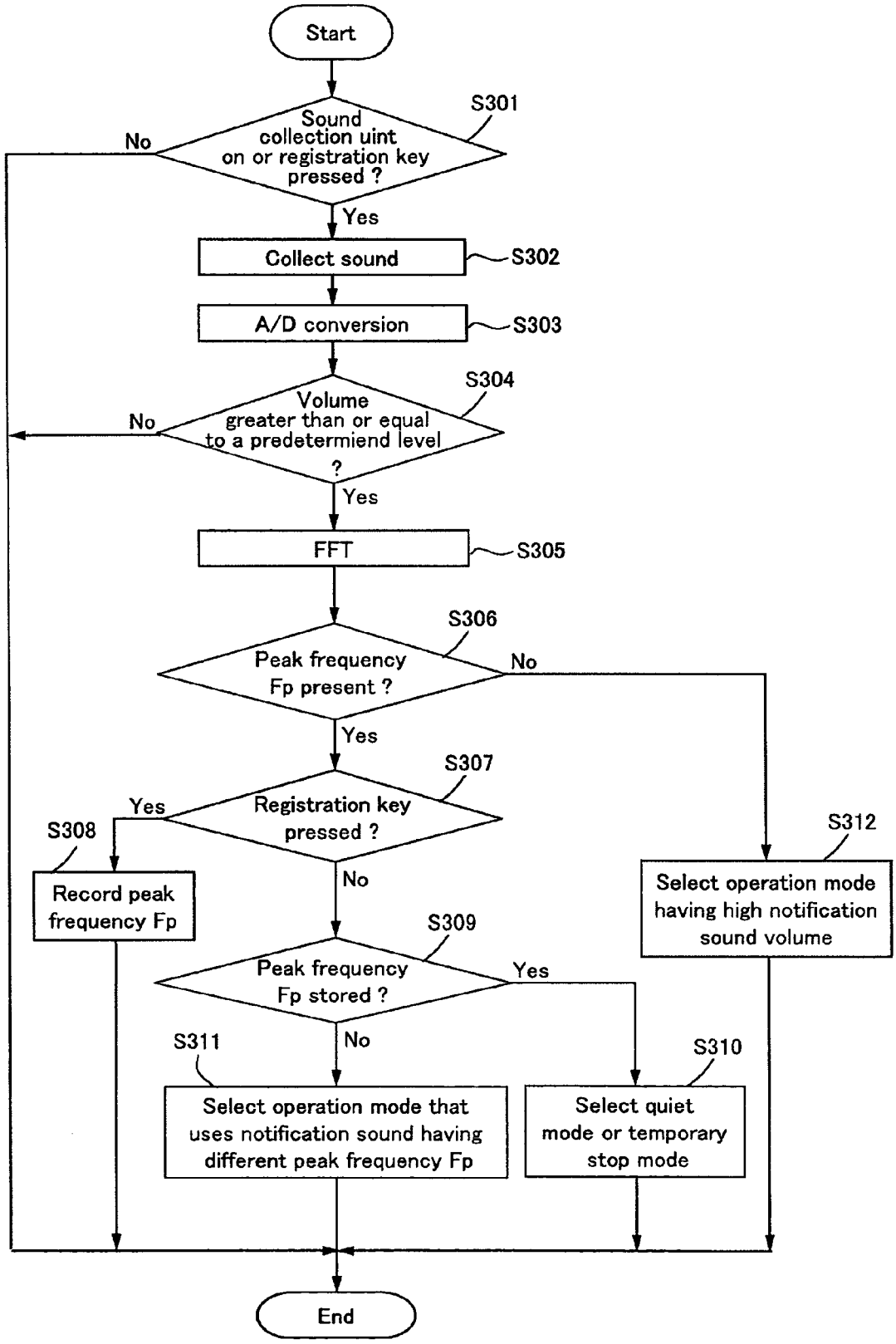
FIG. 3 is a flowchart that describes the process of selecting an operation mode for the image forming device depicted in FIG. 1.

The sound collection unit 101 collects sound only when a registration key 201 displayed on the operation panel 102 is pressed, and when the sound collection unit 101 is supplied with electrical power, i.e., is turned on (FIG. 3, S301–S302).

Sound collected by the sound collection unit 101 is input into a determination unit 103. The determination unit 103 determines the characteristics of the sound input therein. The determination unit 103 performs an analog to digital (A/D) conversion on sound input therein in order to determine the characteristics of the sound. After the A/D conversion, the determination unit 103 will determine whether or not the volume of the collected sound is equal to or greater than a predetermined level (FIG. 3, S304).

The determination unit 103 will end the task of determining the characteristics of the sound if it determines that the volume of the sound is not equal to or greater than a predetermined level.

Figure 2:
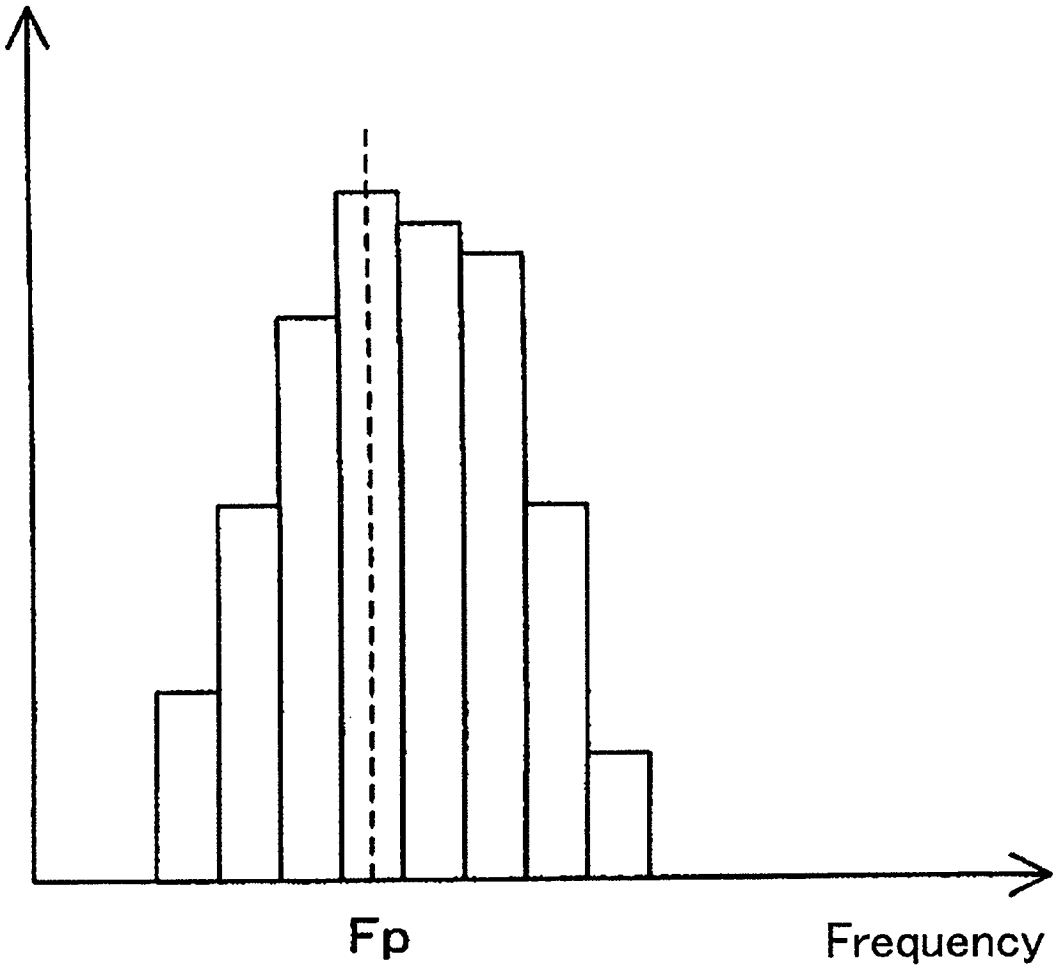
FIG. 2 is a histogram of frequencies obtained by a determination unit in the image forming device depicted in FIG. 1.

If the determination unit 103 determines that the volume of the sound is equal to or greater than a predetermined level, the A/D converted sound is, for example, subject to a Fast Fourier Transformation (FFT) (FIG. 3, S305). Next, as shown in FIG. 2, the determination unit 103 will produce a histogram of the frequencies of the sound that was subject to the FFT. The determination unit 103 will obtain a peak frequency Fp of that sound from the histogram, and will set the peak frequency Fp to be that sound's characteristics (FIG. 3, S306).

Then, like with the sound collection unit 101, when each key displayed on the operation panel 102 is pressed, the instructions corresponding thereto are also input into the determination unit 103. In the present embodiment, the peak frequency Fp of a sound that was input from the sound collection unit 101 to the determination unit 103 within a predetermined time period after the registration key 201 was pressed will be output to the storage unit 104, and the peak frequency Fp of sound input from the sound collection unit 101 to the determination unit 103 outside this predetermined time period will be output to a mode switching unit 105 (FIG. 3, S307). The peak frequency Fp output to the storage unit 104 is stored in the storage unit 104 (FIG. 3, S308).

When a user presses the registration key 201 and a sound such as a ringing telephone or the voice of a company employee working in the office in which the image forming device 100 is disposed is collected by the sound collection unit 101, the peak frequency Fp of each sound collected thereby is stored in the storage unit 104.

On the other hand, the peak frequencies Fp of sounds collected by the sound collection unit 101 outside the predetermined time period after the registration key 201 was pressed will be input into the mode switching unit 105.

When a peak frequency Fp of a sound is input into the mode switching unit 105, the mode switching unit 105 will select the operation mode of the image forming device 100.

First, the mode switching unit 105 will determine whether or not the peak frequency Fp input therein is the same as one of the peak frequencies stored in the storage unit 104 (FIG. 3, S309).

For example, assume that the peak frequencies Fp of the sound of a ringing telephone and the voice of a company employee A are stored in the storage unit 104.

If the peak frequency Fp input into the mode switching unit 105 is the same as the peak frequency Fp of the sound of the ringing telephone or the peak frequency Fp of company employee A's voice that are stored in the storage unit 104, then the mode switching unit 105 will select a quiet mode or a temporary stop mode as the operation mode of the image forming device 100 (FIG. 3, S310). The quiet mode is an operation mode in which the sounds generated by the image forming device 100 during operation are suppressed. The printing speed of the image forming device 100 in the quiet mode will be slower than that of the normal operation mode in order to suppress the noise generated during printing.

The temporary stop mode is an operation mode which completely stops printing and the generation of notification sounds for a fixed period of time after entering the temporary stop mode, and then will perform these operation after the fixed period of time has elapsed.

When the mode switching unit 105 has selected the quiet mode, an instruction corresponding to this will be communicated to a controller 107.

The controller 107 controls such things as printing and the generation of the notification sounds. For example, the controller 107 will control the operation that prints copies of original documents in response to a print request issued by a user, and will control the notification sound that notifies a user that an operation key displayed on the operation panel 102 has been pushed, the notification sound that notifies a user that the image forming device 100 has received data by facsimile, the notification sound that notifies a user that printing is complete, the notification sound that notifies a user that the image forming device 100 is out of paper, and the like. Note also that a print request from a user is issued by operation of number keys, a print key, and the like displayed on the operation panel 102.

When the controller 107 is notified of the selection of the quiet mode, it will cause the image forming device 100 to print more slowly than in the normal operation mode.

When the telephone call that prompted the image forming device 100 to enter the quiet mode is completed, there will no longer be any need to suppress the noise caused by printing, and thus the quiet mode may be cancelled at that point. This cancellation can, for example, be performed by a user by pressing a cancel key 203 displayed on the operation panel 102. When the cancel key 203 is pressed, the instruction corresponding to this action is communicated to the mode switching unit 105. When this communication occurs, the mode switching unit 105 will select the normal operation mode, and notifies the controller 107 that it has selected the normal operation mode. Printing and the like is performed in the normal operation mode after this notification in accordance with control performed by the controller 107.

Thus, if a user presses the registration key 201 and registers the sound of a ringing telephone or the sound of Mr. A's voice, the image forming device 100 will thereafter operate in the quiet mode if the sound collection unit 101 collects the sound of the ringing telephone or the sound of Mr. A's conversation. Because of this, during a telephone conversation conducted by Mr. A, it will not be difficult for Mr. A to hear the person to whom he is speaking even when, for example, data received by facsimile is printed by the image forming device 100, or another person uses the image forming device 100 to print a document.

As noted above, if sounds that are difficult to hear due to other sounds generated by the image forming device 100 during operation are registered in the storage unit 104, e.g., the sound of a ringing telephone or the like, the sounds generated by the image forming device 100 will be suppressed in situations in which these registered sounds are actually generated.

On the other hand, if it is determined in step S309 that the input peak frequency Fp is not stored in the storage unit 104, the mode switching unit 105 will select an operation mode that uses a sound having a frequency different from the peak frequency Fp as a notification sound (FIG. 3, S311).

When this operation mode is selected, the mode switching unit 105 will communicate this selection to the controller 107.

After this communication occurs, a sound having a frequency different from the peak frequency Fp will be used as a notification sound.

Thus, by using a sound having a frequency different from the peak frequency Fp that was input from the determination unit 103 as a notification sound, the likelihood that the notification sound will be heard by a user will increase, even when the sound having the peak frequency Fp that was input from the determination unit 103 is generated in the vicinity of the image forming device 100.

In addition, if sounds are no longer generated in the vicinity of the image forming device 100 or are no longer collected by the sound collector 101 (because it has been turned off), a peak frequency Fp will not be input from the determination unit 103 to the mode switching unit 105. When this occurs, the mode switching unit 105 will select the normal operation mode, and commands corresponding to the normal operation mode will be communicated to the controller 107.

Furthermore, when a sound input from the sound collection unit 101 does not have a peak frequency Fp, there is a strong possibility that this is random background noise, and thus the determination unit 103 will inform the mode switching unit 105 that there is no peak frequency Fp present.

When the mode switching unit 105 is informed that no peak frequency Fp is present, the mode switching unit 105 will select an operation mode in which the volume of the notification sounds is increased (FIG. 3, S312). When this occurs, the mode switching unit 105 will inform the controller 107 that the operation mode in which the volume of the notification sounds is increased has been selected.

When this communication occurs, the controller 107 will thereafter increase the volume of the notification sounds used to notify a user.

Thus, when a sound not having a peak frequency is generated in the vicinity of the image forming device 100, the user can easily hear the notification sounds of the image forming device 100 because the volume thereof will be increased in this operation mode.

If sounds having no peak frequency Fp are no longer generated in the vicinity of the image forming device 100 or can no longer be collected by the sound collector 101, the fact that no peak frequency Fp is present will no longer be input from the determination unit 103 to the mode switching unit 105.

If the fact that there is no peak frequency Fp present is no longer input to the mode switching unit 105, the mode switching unit 105 will select the normal operation mode, and the fact that the normal operation mode was selected will be communicated to the controller 107.

Note also that in the present embodiment, although the characteristic of a sound will be determined by the peak frequency Fp thereof, and as noted above, an operation mode will be selected that uses a sound having a peak frequency that is different from the peak frequency Fp obtained by the determination unit 103 as a notification sound, the characteristic of a sound may also be determined by the volume, tone, pattern, and the like thereof. For example, if the characteristic of a sound is determined by the tone or pattern thereof rather than the peak frequency Fp thereof, the mode switching unit 105 can select an operation mode that will use a sound having a tone or pattern that is different than the tone or pattern obtained by the determination unit 103 as a notification sound.

In addition, if for example a degree of similarity between the stored sound and the input sound is required in order for there to be a correlation therebetween, then the operation mode can be switched based upon this degree of similarity rather than a determination there is an exact match between these sounds as noted above.

2. Second Embodiment

Rather than just one type of quiet mode noted above, there may instead be a plurality of quiet modes. For example, if company employee A's desk is near the image forming device 100 and company employee B's desk is far away from the image forming device 100, the volume of the sound generated by the image forming device 100 will be lower at Mr. B's desk than it will be at Mr. A's desk. Thus, when Mr. B's voice is collected, the mode switching unit 105 can select a corresponding operation mode having a printing speed that is faster than when Mr. A's voice is collected.

In this situation, when the user stores a sound in the storage unit 104, the operation modes that can be selected when the characteristics of that sound are input into the mode switching unit 105 will also be stored in the storage unit 104.

Figure 4:
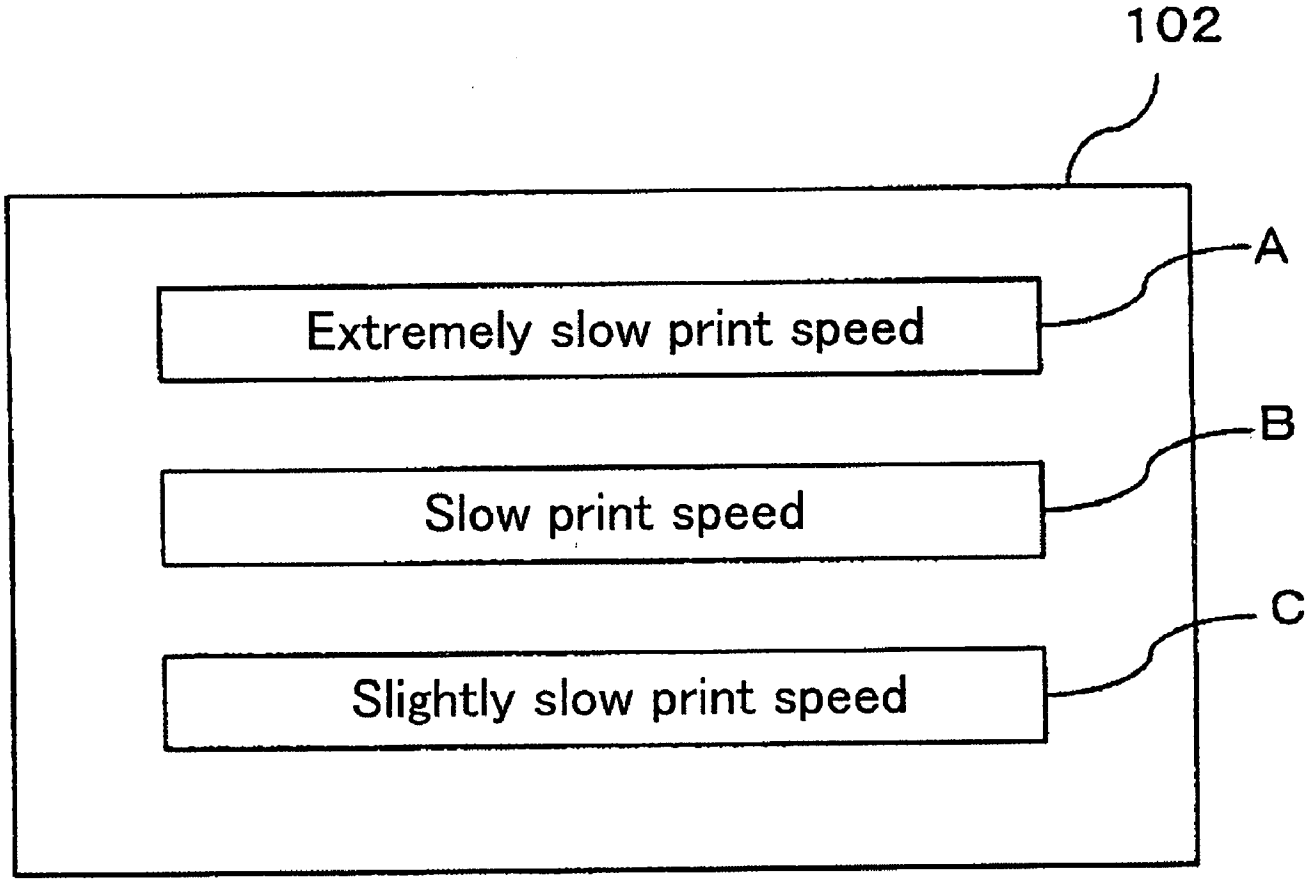
FIG. 4 is a schematic diagram of an operation panel in a situation in which sounds and operation modes are matched with each other.

For example, if the determination unit 103 determines the characteristics of an input sound as described above in the first embodiment, then, as shown in FIG. 4, the operation modes that can be selected by a user will be displayed on the operation panel 102. For example, the user will select A, i.e., "Extremely slow print speed", when he or she attaches importance to quiet, and will select B, i.e., "Slow print speed" or C, i.e., "Slightly slow print speed", when he or she can tolerate the generation of a certain level of sound volume. The mode selected by the user will be input to the determination unit 103.

Then, the determination unit 103 will output the mode selected by the user and the determined characteristics of the sound associated with that mode to the storage unit 104.

This allows the characteristics of a sound to be matched with an operation mode and stored in the storage unit 104.

When the characteristic of a sound is input from the determination unit 103 to the mode switching unit 105, the mode switching unit 105 will select the operation mode that is stored in the storage unit 104 that matches that sound's characteristic.

This allows a user to determine the operation mode to be selected, and allows the image forming device 100 to perform an operation that is closer to that desired by the user based upon the conditions in the vicinity of the image forming device 100.

As noted above, if the image forming device produces sounds during operation that one wants to suppress when one or more particular sounds are generated in the vicinity thereof, and those particular sounds are registered in the storage unit of the image forming device, the image forming device will operate in an operation mode in which the sounds produced by the image forming device will be suppressed when one or more of those particular sounds are actually generated.

In addition, if sounds having characteristics that are different than the sounds generated in the vicinity of the image forming device are used as notification sounds for the image forming device, the image forming device will not prevent disturbances to work that is performed in the vicinity of the image forming device, but will also notify a user of the image forming device with notification sounds that are easy to hear.

The entire disclosure of Japanese Patent Application No. 2003-129815 is incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device, comprising:

a sound collection unit that collects sounds generated in a vicinity of the image forming device;

a determination unit that determines an identifying characteristic of each of the sounds collected by the sound collection unit that have the identifying characteristic;

a storage unit that stores the identifying characteristics of sounds that are designated for storage by a user of the image forming device; and a mode switching unit that will change an operation mode of the image forming device when there is a predetermined degree of similarity or greater between the identifying characteristic of one of the sounds stored in the storage unit and the identifying characteristic of a sound collected by the sound collection unit but not designated for storage in the storage unit;

wherein when the determination unit determines that a sound collected by the sound collection unit does not have the identifying characteristic, the mode switching unit will change to an operation mode that increases the volume of a notification sound.

2. The image forming device set forth in claim 1, wherein the mode switching unit will change to an operation mode that reduces noise generated by the image forming device.

3. The image forming device set forth in claim 1, wherein the mode switching unit will change to an operation mode that reduces print speed.

4. The image forming device set forth in claim 1, wherein the identifying characteristic of a sound is a peak frequency thereof.

5. The image forming device set forth in claim 1, wherein the identifying characteristic of a sound is a volume thereof.

6. The image forming device set forth in claim 1, wherein the identifying characteristic of a sound is a tone thereof.

7. The image forming device set forth in claim 1, wherein the identifying characteristic of a sound is a pattern thereof.

8. The image forming device set forth in claim 1, wherein the mode switching unit will change to an operation mode selected by the user.

9. An image forming device, comprising:

a sound collection unit that collects sounds generated in a vicinity of the image forming device;

a determination unit that determines an identifying characteristic of each of the sounds collected by the sound collection unit that have the identifying characteristic;

a storage unit that stores the identifying characteristics of sounds that are designated for storage by a user of the image forming device; and a mode switching unit that will reduce the print speed of the image forming device when there is a predetermined degree of similarity or greater between the identifying characteristic of one of the sounds stored in the storage unit and the identifying characteristic of a sound collected by the sound collection unit but not designated for storage in the storage unit.

10. An image forming device, comprising:

a sound collection unit that collects sounds generated in a vicinity of the image forming device;

a determination unit that determines an identifying characteristic of each of the sounds collected by the sound collection unit that have the identifying characteristic;

a storage unit that stores the identifying characteristics of sounds that are designated for storage by a user of the image forming device; and a mode switching unit that will change an operation mode of the image forming device when there is a predetermined degree of similarity or greater between the identifying characteristic of one of the sounds stored in the storage unit and the identifying characteristic of a sound collected by the sound collection unit but not designated for storage in the storage unit;

wherein when the degree of similarity between the identifying characteristic of each of the sounds stored in the storage unit and the identifying characteristic of a sound collected by the sound collection unit but not designated for storage in the storage unit is less than the predetermined degree of similarity, the mode switching unit will change to an operation mode that can generate at least one notification sound having an identifying characteristic that is different from the identifying characteristic of the sound collected by the sound collection unit but not designated for storage.

11. An image forming device, comprising:

a sound collection unit that collects sounds generated in a vicinity of the image forming device;

a determination unit that determines an identifying characteristic of each of the sounds collected by the sound collection unit that have the identifying characteristic;

a storage unit that stores the identifying characteristics of sounds that are designated for storage by a user of the image forming device; and a mode switching unit that will change an operation mode of the image forming device when there is a predetermined degree of similarity or greater between the identifying characteristic of one of the sounds stored in the storage unit and the identifying characteristic of a sound collected by the sound collection unit but not designated for storage in the storage unit;

wherein the sound collection unit is capable of collecting a first sound generated at a first position that is a predetermined distance from the image forming device, and a second sound generated at a second position that is further away from the image forming device than the first position;

the mode switching unit will change to a first operation mode when the first sound is collected by the sound collecting unit and change to a second operation mode when the second sound is collected by the sound collecting unit; and the image forming device will generate less noise in the first operation mode than in the second operation mode.

* * * * *